US010208985B2

(12) United States Patent
Najafifard

(10) Patent No.: US 10,208,985 B2
(45) Date of Patent: Feb. 19, 2019

(54) FLASH TANK PRESSURE CONTROL FOR TRANSCRITICAL SYSTEM WITH EJECTOR(S)

(71) Applicant: Heatcraft Refrigeration Products LLC, Stone Mountain, GA (US)

(72) Inventor: Fardis Najafifard, Decatur, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 111 days.

(21) Appl. No.: 15/395,645

(22) Filed: Dec. 30, 2016

(65) Prior Publication Data

US 2018/0187926 A1 Jul. 5, 2018

(51) Int. Cl.
*F25B 1/00* (2006.01)
*F25B 9/00* (2006.01)
(Continued)

(52) U.S. Cl.
CPC ..... *F25B 9/008* (2013.01); *F25B 1/10* (2013.01); *F25B 40/02* (2013.01); *F25B 41/00* (2013.01);
(Continued)

(58) Field of Classification Search
USPC ..... 62/228, 100
See application file for complete search history.

(56) References Cited

U.S. PATENT DOCUMENTS 3,668,884 A * 6/1972 Nebgen ..... F02C 7/143 62/228.5
7,891,201 B1 * 2/2011 Bush ..... F25B 1/10 62/115
(Continued)

FOREIGN PATENT DOCUMENTS

EP 3023712 A1 5/2016
EP 3023713 A1 5/2016

OTHER PUBLICATIONS

Experimental Analysis of the R744 Vapour Compression Rack Equipped With Multi-Ejector Expansion Work Recovery Module (Experimental Analysis), Silesian University of Technology, Aug. 2016.*
(Continued)

*Primary Examiner* — Henry T Crenshaw
(74) *Attorney, Agent, or Firm* — Baker Botts L.L.P.

(57) ABSTRACT

In certain embodiments, a transcritical refrigeration system provides refrigeration by circulating carbon dioxide ($CO_2$) refrigerant through the system. A flash tank of the transcritical refrigeration system is operable to supply the $CO_2$ refrigerant, in liquid form, to a low temperature refrigeration case and a medium temperature refrigeration case. A low temperature compressor is operable to compress the $CO_2$ refrigerant discharged from the low temperature refrigeration case. A medium temperature compressor, a parallel compressor, and an ejector are each operable to compress the $CO_2$ refrigerant discharged from the medium temperature refrigeration case, the $CO_2$ refrigerant discharged from the low temperature compressor, and/or $CO_2$ flash gas discharged from the flash tank. A gas cooler is operable to cool the $CO_2$ refrigerant discharged from the medium temperature compressor and the parallel compressor. A controller is operable to dynamically adjust a pressure set point for the flash tank.

14 Claims, 5 Drawing Sheets

(51) Int. Cl.

| | |
|---|---|
| ***F25B 40/02*** | (2006.01) |
| ***F25B 41/00*** | (2006.01) |
| ***F25B 1/10*** | (2006.01) |
| ***F25B 49/02*** | (2006.01) |
| *F25B 5/02* | (2006.01) |

(52) U.S. Cl.

CPC ..... *F25B 49/02* (2013.01); *F25B 5/02* (2013.01); *F25B 2309/061* (2013.01); *F25B 2341/0012* (2013.01); *F25B 2341/0662* (2013.01); *F25B 2400/075* (2013.01); *F25B 2400/13* (2013.01); *F25B 2400/23* (2013.01); *F25B 2700/21* (2013.01); *F25B 2700/2102* (2013.01); *F25B 2700/2106* (2013.01)

(56) References Cited

U.S. PATENT DOCUMENTS

2006/0174639 A1* 8/2006 Lee ..... F25B 1/10 62/160
2010/0115975 A1* 5/2010 Mitra ..... F25B 1/10 62/196.1
2010/0132399 A1* 6/2010 Mitra ..... F25B 9/008 62/498
2011/0162397 A1* 7/2011 Huff ..... F25B 1/10 62/115
2012/0227427 A1* 9/2012 Liu ..... F25B 1/10 62/115
2012/0318008 A1* 12/2012 Liu ..... F25B 9/008 62/115
2013/0098086 A1* 4/2013 Sillato ..... F25B 49/02 62/184
2014/0208785 A1* 7/2014 Wallace ..... F25B 9/008 62/115
2015/0219379 A1* 8/2015 Sun ..... F25B 1/10 62/115
2016/0102901 A1* 4/2016 Christensen ..... F25B 9/008 62/117
2017/0328604 A1* 11/2017 Fredslund ..... F25B 9/008

OTHER PUBLICATIONS

Haida, et al. "Experimental Analysis of the R744 Vapour Compression Rack Equipped with the Multi-Ejector Expansion Work Recovery Module", Paper ID 1079; The 12$^{th}$ IIR Gustav Lorentzen Natural Working Fluids Conference, Edinburgh, 8 pages, Aug. 21-24, 2016.
Extended European Search Report in EP Application No. 17209511.9-1008, dated May 24, 2018, 9 pages.

* cited by examiner

FLASH TANK PRESSURE CONTROL FOR TRANSCRITICAL SYSTEM WITH EJECTOR(S)

TECHNICAL FIELD

This disclosure relates generally to an refrigeration system. More specifically, this disclosure relates to flash tank pressure control for a transcritical system with one or more ejectors.

BACKGROUND

Refrigeration systems can be used to regulate the environment within an enclosed space. Various types of refrigeration systems, such as residential and commercial, may be used to maintain cold temperatures within an enclosed space such as a refrigerated case. To maintain cold temperatures within refrigerated cases, refrigeration systems control the temperature and pressure of refrigerant as it moves through the refrigeration system. When controlling the temperature and pressure of the refrigerant, refrigeration systems consume power. It is generally desirable to operate refrigeration systems efficiently in order to avoid wasting power.

SUMMARY OF THE DISCLOSURE

In certain embodiments, a transcritical refrigeration system provides refrigeration by circulating carbon dioxide ($CO_2$) refrigerant through the system. A flash tank of the transcritical refrigeration system is operable to supply the $CO_2$ refrigerant, in liquid form, to a low temperature refrigeration case and a medium temperature refrigeration case. A low temperature compressor is operable to compress the $CO_2$ refrigerant discharged from the low temperature refrigeration case. A medium temperature compressor, a parallel compressor, and an ejector are each operable to compress the $CO_2$ refrigerant discharged from the medium temperature refrigeration case, the $CO_2$ refrigerant discharged from the low temperature compressor, and/or $CO_2$ flash gas discharged from the flash tank. A gas cooler is operable to cool the $CO_2$ refrigerant discharged from the medium temperature compressor and the parallel compressor. A controller is operable to dynamically adjust a pressure set point for the flash tank.

In certain embodiments, the controller dynamically adjusts the pressure set point for the flash tank based on a temperature at an outlet of the gas cooler. For example, in response to determining that the temperature at the outlet of the gas cooler has increased such that it exceeds a first temperature threshold, the controller adjusts the pressure set point for the flash tank in order to increase $\Delta p$, wherein $\Delta p$ is the difference between the pressure of the flash tank and suction pressure of the medium temperature compressor. In response to determining that the temperature at the outlet of the gas cooler has decreased such that it is less than a second temperature threshold, the controller adjusts the pressure set point for the flash tank in order to decrease $\Delta p$.

As another example, in response to determining that the temperature at the outlet of the gas cooler is less than or equal to 30° C., the controller adjusts the pressure set point for the flash tank such that $\Delta p$ is less than or equal to 8 bar. In certain embodiments, in response to determining that the temperature at the outlet of the gas cooler is less than or equal to 28° C., the controller adjusts the pressure set point for the flash tank such that $\Delta p$ is less than 8 bar (e.g., the $\Delta p$ may be 6 bar). As yet another example, in response to determining that the temperature at the outlet of the gas cooler is greater than or equal to 32° C., the controller adjusts the pressure set point for the flash tank such that $\Delta p$ is greater than or equal to 8 bar. In certain embodiments, in response to determining that the temperature at the outlet of the gas cooler is greater than or equal to 34° C., the controller adjusts the pressure set point for the flash tank such that the $\Delta p$ is greater than 8 bar (e.g., the $\Delta p$ may be 10 bar).

In certain embodiments the controller determines temperature at the outlet of the gas cooler based on a sensor that measures gas cooler outlet temperature. In certain embodiments, the controller determines gas cooler outlet temperature according to an approximation based at least in part on a measurement from an ambient air temperature sensor located proximate to the gas cooler.

In certain embodiments, the controller is further operable to determine one or more compression set points operable to cause a measured pressure of the flash tank to move toward the pressure set point for the flash tank. The controller then instructs each of the medium temperature compressor, the parallel compressor, and/or the ejector to operate according to its respective compression set point.

Also disclosed is a controller for a refrigeration system. The controller comprises one or more processors and logic encoded in non-transitory computer readable memory. The logic, when executed by one or more processors, is operable to dynamically adjust a pressure set point for a flash tank based on ambient air temperature and/or gas cooler outlet temperature. As an example, the logic is operable to determine that the ambient air temperature and/or the gas cooler outlet temperature has increased such that it exceeds a temperature threshold and to adjust the pressure set point for the flash tank in order to increase $\Delta p$. The $\Delta p$ is the difference between the pressure of the flash tank and suction pressure of a compressor of the refrigeration system. In certain embodiments the controller determines the ambient air temperature based on information from a sensor that measures the ambient air temperature proximate to the gas cooler. In certain embodiments the controller determines the gas cooler outlet temperature based on information from a sensor at the outlet of the gas cooler.

Also discloses is a method of operating a refrigeration system. The method comprises determining a temperature associated with an outlet of a gas cooler (such as an ambient temperature of outdoor air proximate to the gas cooler), performing a comparison that compares the temperature associated with the outlet of the gas cooler to a temperature threshold, adjusting a pressure set point for a flash tank based on the comparison, and instructing one or more components of the refrigeration system to operate according to a configuration that causes a measured pressure of the flash tank to move toward the pressure set point for the flash tank.

Certain embodiments may provide one or more technical advantages. Certain embodiments may result in more efficient operation of refrigeration system. For example, instead of keeping flash tank pressure constant all of the time, the pressure of the flash tank can be increased or decreased based on gas cooler outlet temperature in order to increase the efficiency of the ejector and/or reduce energy usage associated with parallel compression. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

In general, a refrigeration system cools a refrigeration load using cool liquid refrigerant circulated from a flash tank to the refrigeration load. As an example, the refrigeration load may include one or more temperature-controlled cases, such as low temperature (LT) and medium temperature (MT) grocery store cases for storing frozen food and fresh food (e.g., fruits, vegetables, eggs, milk, beverages, etc.), respectively. Cooling the refrigeration load causes the refrigerant to expand and to increase in temperature. The refrigeration system compresses and cools the refrigerant discharged from the refrigeration load so that cool liquid refrigerant can be recirculated through the refrigeration system to keep the refrigeration load cool.

To compress the refrigerant, the refrigeration system includes one or more compressors. Examples of compressors include one or more LT compressors configured to compress refrigerant from the LT case and an MT compressor configured to compress refrigerant from the MT case. The compressors may also include one or more parallel compressors and one or more ejector(s). Generally, a parallel compressor operates "in parallel" to another compressor (such as an MT compressor) of the refrigeration system, thereby reducing the amount of compression that the other compressor needs to apply. Similarly, an ejector can act as a compressor to reduce the amount of compression that another compressor needs to apply.

Inclusion of one or more parallel compressor(s) and/or one or more ejector(s) may be associated with certain energy efficiency benefits. As further discussed below, the efficiency of the parallel compressor and the ejector(s) depends on the flash tank pressure and the gas cooler outlet temperature. Accordingly, embodiments of the present disclosure allow for dynamically adjusting the set point for the flash tank pressure based on the gas cooler outlet temperature. This may improve efficiency as compared to conventional refrigeration systems that maintain the flash tank pressure at a constant set point, such as 520 psi.

Embodiments of the present disclosure and its advantages are best understood by referring to FIGS. 1 through 6 of the drawings, like numerals being used for like and corresponding parts of the various drawings.

Figure 1:
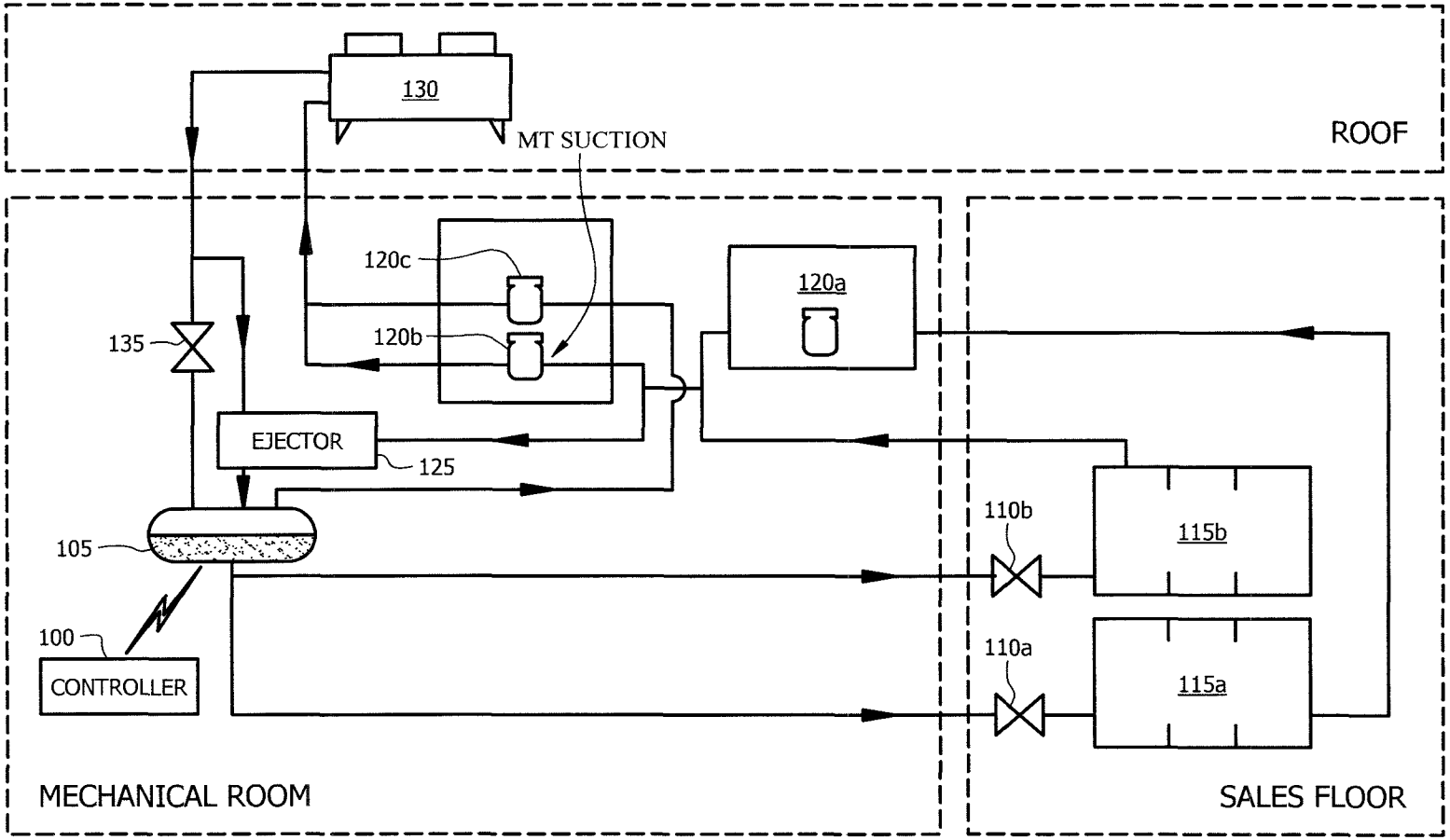
FIG. 1 is a block diagram illustrating an example refrigeration system according to certain embodiments of the present disclosure.

FIG. 1 illustrates an example of a transcritical refrigeration system. A transcritical refrigeration system may include a controller 100, a flash tank 105, one or more evaporator valves 110 corresponding to one or more evaporators 115, at least two compressors 120, one or more ejectors 125, a gas cooler 130, and an expansion valve 135. As depicted in FIG. 1, the refrigeration system includes two evaporator valves (110*a* and 110*b*) corresponding to two evaporators (115*a* and 115*b*), and three compressors 120*a-c*. Each component may be installed in any suitable location, such as a mechanical room (e.g., FIG. 1 depicts flash tank 105, compressors 120, ejector 125, and expansion valve 135 in a mechanical room), in a consumer-accessible location (e.g., FIG. 1 depicts evaporator valves 110 and evaporators 115 on a sales floor), or outdoors (e.g., FIG. 1 depicts gas cooler 130 on a rooftop).

First valve 110*a* may be configured to discharge low-temperature liquid refrigerant to first evaporator 115*a* (also referred to herein as low-temperature ("LT") case 115*a*). Second valve 110*b* may be configured to discharge medium-temperature liquid refrigerant to evaporator 115*b* (also referred to herein as medium-temperature ("MT") case 115*b*). In certain embodiments, LT case 115*a* and MT case 115*b* may be installed in a grocery store and may be used to store frozen food and refrigerated fresh food, respectively. In some embodiments, first evaporator 115*a* may be configured to discharge warm refrigerant vapor to first compressor 120*a* (also referred to herein as an LT compressor 120*a*) and second evaporator 115*b* may be configured to discharge warm refrigerant vapor to a second compressor 120*b* (also referred to herein as an MT compressor 120*b*). In such a refrigeration system, first compressor 120*a* provides a first stage of compression to the warmed refrigerant from the LT case 115*a* and discharges the compressed refrigerant to second compressor 120*b*, parallel compressor 120*c*, and/or ejector 125 (e.g., depending on the configuration of refrigerant lines and valves within the system).

For example, in certain embodiments, the compressed refrigerant discharged from first compressor 120*a* joins the warm refrigerant discharged from MT case 115*b* and flows to second compressor 120*b*, parallel compressor 120*c*, and/or ejector 125 for compression. The inlet to second compressor 120*b* may be referred to as MT suction. The refrigerant discharged from second compressor 120*b* and/or parallel compressor 120*c* may then be discharged to gas cooler 130 for cooling. Gas cooler 130 discharges mixed-state refrigerant (e.g., refrigerant in both vapor and liquid form). During normal operation, the refrigerant discharged from gas cooler 130 may continue to ejector 125. During bypass operation, the refrigerant discharged from gas cooler 130 may continue to an open expansion valve 135. The mixed-state refrigerant then flows from ejector 125 or expansion valve 135 through flash tank 105 where it is separated into vapor (i.e., flash gas) and liquid refrigerant.

The liquid refrigerant flows from the flash tank 105 to one or more of the cases 115 through evaporator valves 110 and the cycle begins again. The vapor refrigerant flows from the flash tank 105 to one or more of MT compressor 120*b* and/or parallel compressor 120*c*. In certain embodiments, the pressure of flash tank 105 may be adjusted depending on the gas cooler outlet temperature to ensure efficient operation of parallel compressor 120*c* and/or ejector 125. The gas cooler outlet temperature may refer to the temperature of refrigerant at an outlet of gas cooler 130. In certain conditions, the gas cooler outlet temperature may be determined from a sensor at the outlet of gas cooler 130 (such as a sensor that measures outdoor air temperature, for example, if gas cooler 130 is located on the rooftop of a building or other outdoor location).

In some embodiments, refrigeration system 100 may be configured to circulate natural refrigerant such as a hydrocarbon (HC) like carbon dioxide ($CO_2$), propane ($C_3H_8$), isobutane ($C_4H_{10}$), water ($H_2O$), and air. Natural refrigerants may be associated with various environmentally conscious benefits (e.g., they do not contribute to ozone depletion and/or global warming effects). As an example, certain embodiments can be implemented in a transcritical refrigeration system (i.e., a refrigeration system in which the heat rejection process occurs above the critical point) comprising a gas cooler and circulating the natural refrigerant $CO_2$. Table 1 below illustrates an example of the transcritical point for an embodiment of a $CO_2$ transcritical refrigeration system. Table 1 also shows the vapor percentage in flash tank 105 vs. the outlet temperature of gas cooler 130. In general, the vapor percentage increases as the temperature increases. As the amount of vapor produced in the flash tank 105 increases, it becomes more important to have higher efficiency parallel compression. At lower temperatures with less vapor, parallel compression efficiency becomes less important, so the system can be configured for higher ejector efficiency.

TABLE 1

| Gas Cooler Outlet Temperature | State | Approximate Flash Tank Vapor % |
|---|---|---|
| 25° C., 77° F. | Subcritical | 23% |
| 28° C., 82.5° F. | Subcritical | 28% |
| 30° C., 86° F. | Subcritical | 30% |
| 31.10° C., 87.98° F. | Transcritical Point | 33% |
| 34° C., 93° F. | Supercritical | 38% |
| 35° C., 95° F. | Supercritical | 41% |
| 36° C., 97° F. | Supercritical | 44% |
| 37.7° C., 100° F. | Supercritical | 50% |

The refrigeration system may include at least one controller 100 in some embodiments. Controller 100 may be configured to direct the operations of the refrigeration system. Controller 100 may be communicably coupled to one or more components of the refrigeration system (e.g., flash tank 105, evaporator valves 110, evaporators 115, compressors 120, ejectors 125, gas cooler 130, and/or expansion valve 135). As such, controller 100 may be configured to control the operations of one or more components of refrigeration system 100. For example, controller 100 may be configured to turn parallel compressor 120*c* on and off. As another example, controller 100 may be configured to open and close valve(s) 110 and/or 135. As another example, controller 100 may be configured to adjust a set point for the pressure of flash tank 105.

In some embodiments, controller 100 may further be configured to receive information about the refrigeration system from one or more sensors. As an example, controller 100 may receive information about the ambient temperature of the environment (e.g., outdoor temperature) from one or more sensors. As another example, controller 100 may receive information about the system load from sensors associated with compressors 120. As yet another example, controller 100 may receive information about the temperature and/or pressure of the refrigerant from sensors positioned at any suitable point(s) in the refrigeration system (e.g., temperature at the outlet of gas cooler 130, suction pressure of MT compressor 120*b*, pressure of flash tank 105, etc.).

As described above, controller 100 may be configured to provide instructions to one or more components of the refrigeration system. Controller 100 may be configured to provide instructions via any appropriate communications link (e.g., wired or wireless) or analog control signal. As depicted in FIG. 1, controller 100 is configured to communicate with components of the refrigeration system. For example, in response to receiving an instruction from controller 100, the refrigeration system may adjust a set point associated with the pressure of flash tank 105. An example of a method that may be performed by the refrigeration system based, for example, based on instructions from controller 100 is further described below with respect to FIG. 5. An example of controller 100 is further described below with respect to FIG. 6. In some embodiments, controller 100 includes or is a computer system.

As discussed above, the refrigeration system includes one or more compressors 120. The refrigeration system may include any suitable number of compressors 120. Compressors 120 may vary by design and/or by capacity. For example, some compressor designs may be more energy efficient than other compressor designs and some compressors 120 may have modular capacity (i.e., capability to vary capacity). As described above, compressor 120*a* may be an LT compressor that is configured to compress refrigerant discharged from an LT case (e.g., LT case 115*a*) and compressor 120*b* may be an MT compressor that is configured to compress refrigerant discharged from an MT case (e.g., MT case 115*b*).

In some embodiments, refrigeration system includes a parallel compressor 120*c*. Parallel compressor 120*c* may be configured to provide supplemental compression to refrigerant circulating through the refrigeration system. For example, parallel compressor 120*c* may be operable to compress flash gas discharged from flash tank 105. Refrigeration system may include one or more ejectors 125 configured to provide supplemental compression to refrigerant discharged from MT case 115*b* and/or LT compressor 120*a*. In general, ejector 125 may be smaller than parallel compressor 120*c* and may be powered by pressure (whereas parallel compressor 120*c* is typically powered by electricity). Ejector 125 may discharge refrigerant directly to flash tank 105 (whereas parallel compressor 120*c* may discharge refrigerant to gas cooler 130).

While ejector 125 is running, it compresses some of the load from MT suction (e.g., 420 psi) to flash tank 105 (e.g., 520 psi). The parallel compressor(s) 120*c* work to keep the pressure of flash tank 105 at a set point, such as 520 psi, by compressing vapor from flash tank 105 to MT discharge. As further discussed below, the flash tank pressure set point is determined dynamically based on the temperature at the outlet of gas cooler 130 or the ambient temperature (e.g., outdoor air temperature). The flash tank pressure can be controlled by controlling compressor set points.

As depicted in FIG. 1, the refrigeration system may include one or more gas coolers 130 in some embodiments. Gas cooler 130 is configured to receive compressed refrigerant vapor (e.g., from MT and parallel compressors 120*b*, 120*c*) and cool the received refrigerant. In some embodiments, gas cooler 130 is a heat exchanger comprising cooler tubes configured to circulate the received refrigerant and coils through which ambient air is forced. Inside gas cooler 130, the coils may absorb heat from the refrigerant, thereby providing cooling to the refrigerant. In some embodiments, the refrigeration system includes an expansion valve 135. During normal operation, the refrigerant discharged from gas cooler 130 may continue to ejector 125 for compression and discharge to flash tank 105. During bypass operation, the refrigerant discharged from gas cooler 130 may continue to an open expansion valve 135. Expansion valve 135 may be configured to reduce the pressure of refrigerant. In some embodiments, this reduction in pressure causes some of the refrigerant to vaporize. As a result, mixed-state refrigerant (e.g., refrigerant vapor and liquid refrigerant) is discharged from expansion valve 135. In some embodiments, this mixed-state refrigerant is discharged to flash tank 105.

Refrigeration system 100 may include a flash tank 105 in some embodiments. Flash tank 105 may be configured to receive mixed-state refrigerant and separate the received refrigerant into flash gas and liquid refrigerant. Typically, the flash gas collects near the top of flash tank 105 and the liquid refrigerant is collected in the bottom of flash tank 105. In some embodiments, the liquid refrigerant flows from flash tank 105 and provides cooling to one or more evaporates (cases) 115 and the flash gas flows to one or more compressors (e.g., MT compressor 120*b* and/or parallel compressor 120*c*) for compression.

The refrigeration system may include one or more evaporators 115 in some embodiments. As depicted in FIG. 1, the refrigeration system includes two evaporators 115 (LT case 115*a* and MT case 115*b*). As described above, LT case 115*a* may be configured to receive liquid refrigerant of a first temperature and MT case 115*b* may be configured to receive liquid refrigerant of a second temperature, wherein the first temperature (e.g., −29° C.) is lower in temperature than the second temperature (e.g., −7° C.). As an example, an LT case 115*a* may be a freezer in a grocery store and an MT case 115*b* may be a cooler in a grocery store.

In some embodiments, the liquid refrigerant leaves flash tank 105 through a first line to the LT case and a second line to the MT case. When the refrigerant leaves flash tank 105, the temperature and pressure in the first line may be the same as the temperature and pressure in the second line (e.g., 4° C. and 38 bar). Before reaching cases 115, the liquid refrigerant may be directed through one or more evaporator valves 110 (e.g., 110*a* and 110*b* of FIG. 1). In some embodiments, each valve may be controlled (e.g., by controller 100) to adjust the temperature and pressure of the liquid refrigerant. For example, valve 110*a* may be configured to discharge the liquid refrigerant at −29° C. and 14 bar to LT case 115*a* and valve 110*b* may be configured to discharge the liquid refrigerant at −7° C. and 30 bar to MT case 115*b*. In some embodiments, each evaporator 115 is associated with a particular valve 110 and the valve 110 controls the temperature and pressure of the liquid refrigerant that reaches that evaporator 115.

This disclosure recognizes that a refrigeration system, such as that depicted in FIG. 1, may comprise one or more other components. As an example, the refrigeration system may comprise one or more desuperheaters in some embodiments. One or ordinary skill in the art will appreciate that the refrigeration system may include other components not mentioned herein.

Figure 2:
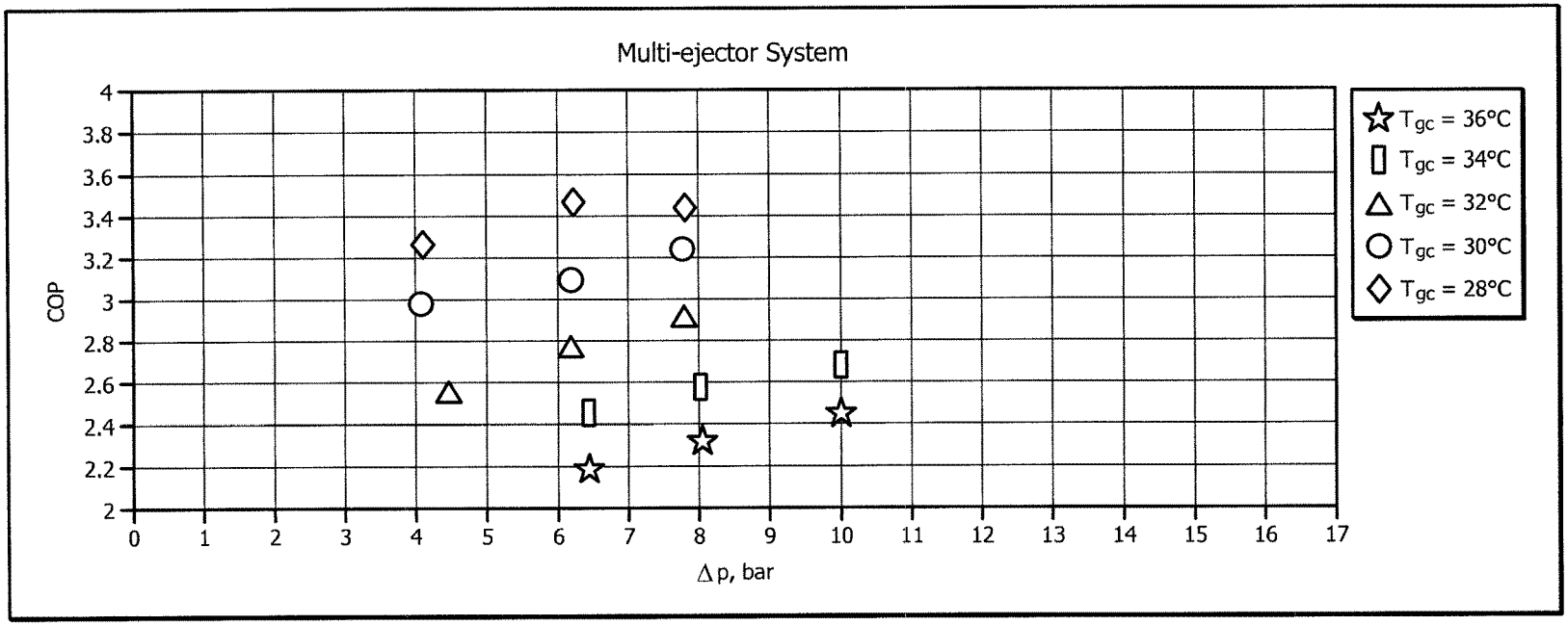
FIGS. 2-4 are graphs illustrating examples of efficiency characteristics for a refrigeration system under various temperature and pressure conditions.
Figure 3:
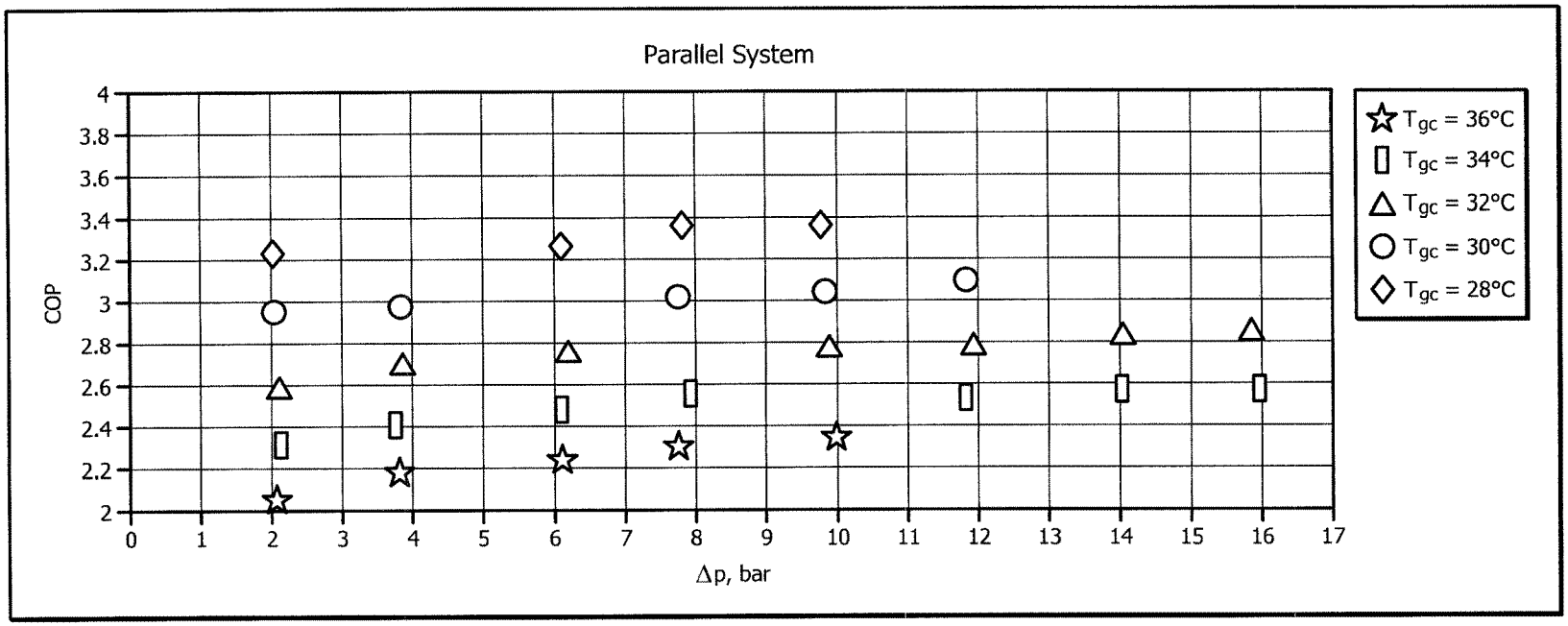
Figure 4:
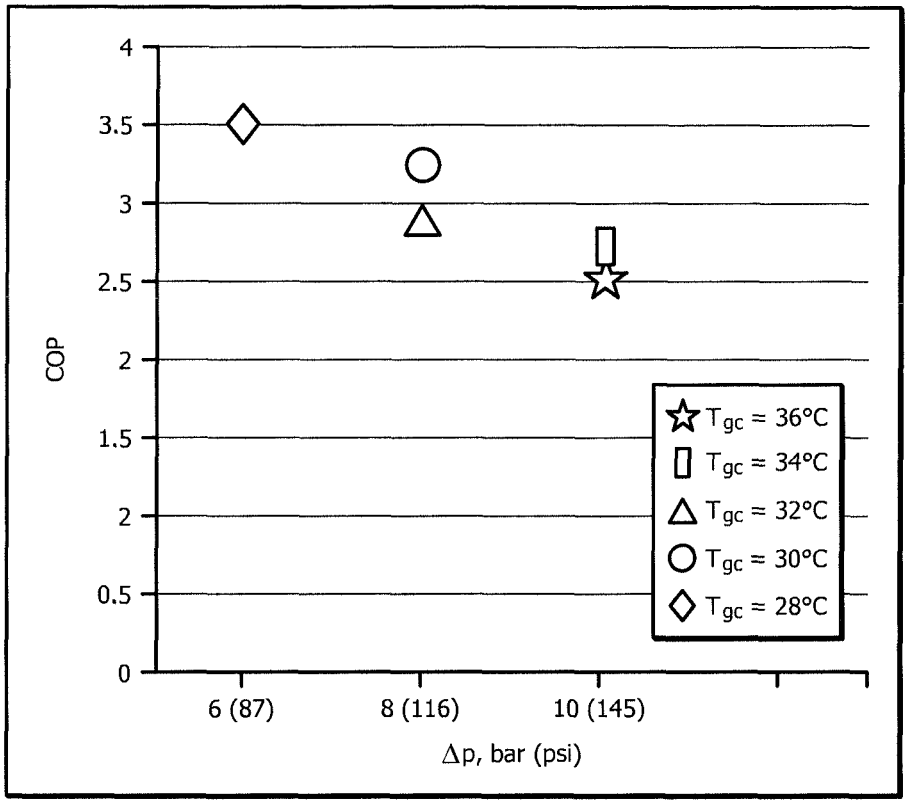

FIGS. 2-4 are graphs illustrating examples of efficiency characteristics for a for a $CO_2$ transcritical refrigeration system under various temperature and pressure conditions. For example, FIG. 2 illustrates coefficient of performance (COP) values for a multi-ejector system. The graph shows the COP values for various gas cooler outlet temperatures (e.g., 28° C., 30° C., 32° C., 34° C., and 36° C.) and various pressures, Δp, wherein Δp refers to a difference between the pressure of flash tank 105 and the suction pressure of MT compressor 120*b*. As depicted in FIG. 2, the COP value generally increases/improves such that the system is more efficient as temperature decreases. As an example, at a Δp of approximately 6 bar, the COP value at 28° C. and is greater than 3.4, which is more efficient than the COP value at 36° C. because at 36° C. the COP value is less than 2.2. In general, the pressure that yields the most efficient COP value depends on the temperature. For example, as depicted in FIG. 2, when the temperature is 28° C., the system is most efficient at a Δp of approximately 6 bar. By contrast, the Δp of approximately 6 bar is not the most efficient value when the temperature is 36° C. (e.g., the COP value is less than 2.2). When the temperature is 36° C., a better COP value is realized at a Δp of approximately 10 bar (e.g., the COP value is greater than 2.4).

FIG. 3 is similar to FIG. 2 except that it depicts a parallel system. Similar to the multi-ejector system of FIG. 2, efficiency of the parallel system improves as temperature decreases and the pressure (Δp) that yields the most efficient COP value depends on the temperature.

Based on the foregoing, it can be determined that ejector 125 has a higher efficiency when the pressure difference between flash tank and MT suction is lower (lower lift pressure). In contrast, parallel compressor 120*c* has higher efficiency when the pressure difference between flash tank and MT suction is higher. In addition, the ambient temperature and the gas cooler outlet temperature have a direct relationship to the amount of $CO_2$ vapor after high pressure expansion valve 135. Depending on the ambient temperature and gas cooler outlet temperature, the increase of the transcritical booster system Coefficient of Performance (COP) can be achieved by either increasing parallel compression efficiency or increasing ejector efficiency.

Thus, instead of keeping the flash tank pressure constant all the time, the pressure of flash tank 105 can be increased or decreased based on gas cooler outlet temperature to increase the efficiency of the ejector and reduce energy usage of parallel compression. At certain gas cooler outlet temperatures, parallel compressor efficiency may be considered more important than ejector efficiency for maintaining the overall efficiency of the refrigeration system. As examples, for certain $CO_2$ transcritical systems, parallel compressor efficiency may be considered more important than ejector efficiency when the gas cooler outlet temperature is greater than 31° C., greater than 32° C., or greater than 33° C. depending on the embodiment. At these temperatures, the pressure difference between the flash tank and MT suction can be increased to improve the efficiency of the parallel compressor.

At other temperatures, ejector efficiency becomes more important than parallel compressor efficiency for maintaining the overall efficiency of the refrigeration system. As examples, for certain $CO_2$ transcritical systems, ejector efficiency may be considered more important than parallel compressor efficiency when the gas cooler outlet temperature is less than 33° C., less than 32° C., or less than 31° C. depending on the embodiment. At these temperatures, the pressure difference between the flash tank and MT suction can be decreased to improve the efficiency of the ejector(s).

FIG. 4 illustrates examples of pressure difference between MT suction and flash tank that may be used in certain transcritical $CO_2$ refrigeration systems in order to maximize the COP value at various temperatures depending on whether parallel compressor efficiency or ejector efficiency is considered more important for a given temperature. In FIG. 4, the Δp value may be set to 6 bar (87 psi) for a gas cooler outlet temperature of 28° C. to 30° C. (82.5° F. to 86° F.), and parallel compression suction pressure may be set to 507 psi in controls. The Δp value may be set to 8 bar (116 psi) for gas cooler outlet temperature of 30° C. to 33° C. (82.5° F. to 91.5° F.), and parallel compression suction pressure may be set to 536 psi in controls. The Δp value may be set to 10 bar (145 psi) for gas cooler outlet temperature above 33° C. (91.5° F.), and parallel compression suction pressure may be set to 565 psi in controls.

Figure 5:
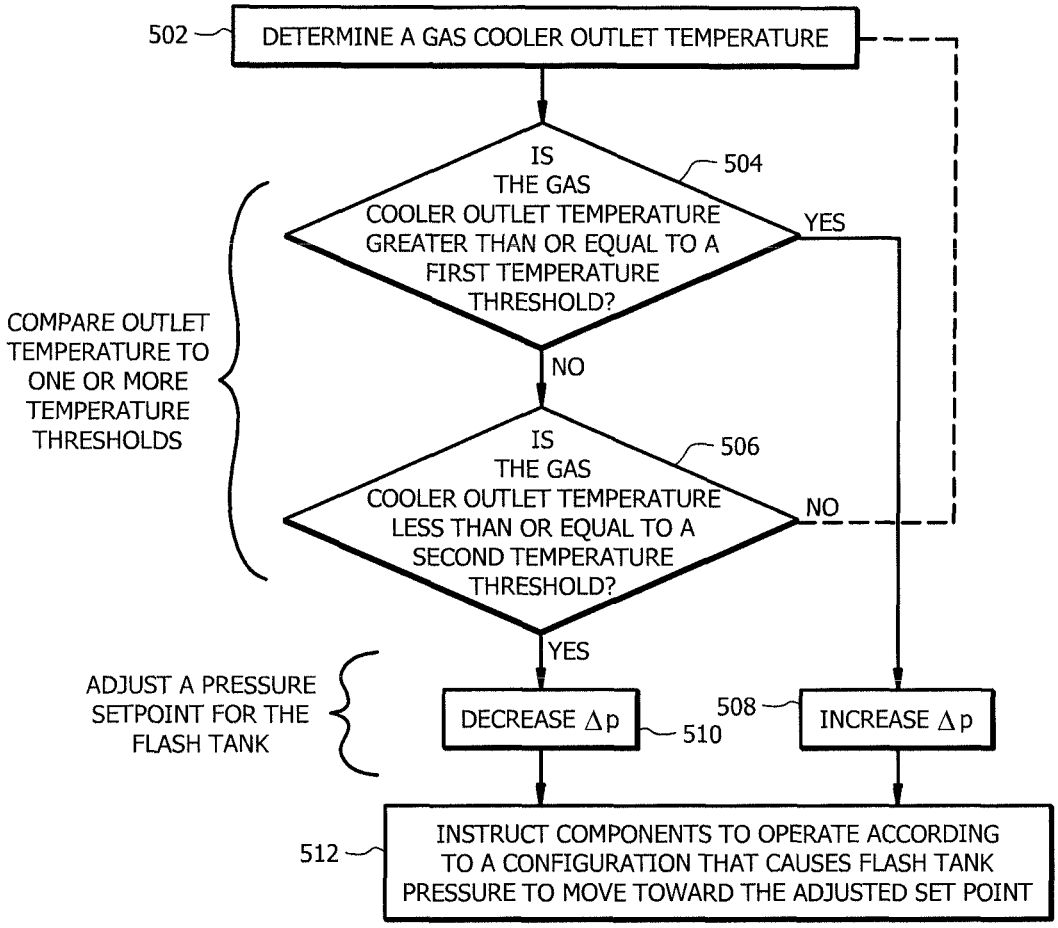
FIG. 5 is a flow chart illustrating a method of operation for a refrigeration system, according to certain embodiments of the present disclosure.

FIG. 5 illustrates an example of a method of operating a refrigeration system, such as the refrigeration system described with respect to FIG. 1, in accordance with certain embodiments. In some embodiments, the method may be performed by controller 100, for example, using a processor 630 to execute logic stored in memory 620 of controller 100 (as further discussed below with respect to FIG. 6). For purposes of example and explanation, the steps of FIG. 5 are discussed with reference to the temperature thresholds and Δp set points illustrated in FIG. 4. However, other embodiments may use different thresholds and set points. Moreover, the thresholds and set points may be determined in any suitable manner. In certain embodiments, the thresholds and set points may be pre-configured by a manufacturer or technician. In other embodiments, the refrigeration system may determine the thresholds and set points dynamically, for example, by testing/monitoring the system efficiency in various configurations and saving the configuration that is the most efficient.

When the method begins, the refrigeration system may be operating according to an initial Δp value, such as 8 bar. At step 502, the method determines a temperature associated with an outlet of a gas cooler 130. As discussed above, gas cooler 130 is operable to cool refrigerant received from one or more compressors (e.g., MT compressor 120*b* and parallel compressor 120*c*) and discharge the refrigerant to a flash tank 105 via one or more ejectors 125. In certain embodiments, the method determines the gas cooler outlet temperature based on information from a sensor configured to measure the temperature at the outlet of the gas cooler 130. In an alternate embodiment, the method may assume that the gas cooler 130 cools the refrigerant to an outdoor ambient temperature and may use an ambient air temperature measured by an ambient air temperature sensor or received from a weather report (e.g., via the Internet) as the gas cooler outlet temperature.

After determining the gas cooler outlet temperature, the method performs a comparison that compares the gas cooler outlet temperature to a temperature threshold. Steps 504 and 506 each illustrate examples of comparing the gas cooler outlet temperature to a threshold. As an example, at step 504, the method determines whether the gas cooler outlet temperature is greater than or equal to a first temperature threshold. Using the values in FIG. 4 as an example, the first temperature threshold may be 34° C. If the gas cooler outlet temperature determined at step 502 is less than 34° C. (i.e., the gas cooler outlet temperature is not greater than or equal to the first temperature threshold), the method proceeds to step 506. At step 506, the method determines whether the as cooler outlet temperature is less than or equal to a second temperature threshold. Using the values in FIG. 4 as an example, the second temperature threshold may be 28° C. If the gas cooler outlet temperature determined at step 502 is greater than 28° C. (i.e., the gas cooler outlet temperature is not less than or equal to the second temperature threshold), the method may return to step 502 to determine an updated gas cooler outlet temperature and begin the method again. In certain embodiments, the method may wait for the occurrence of a predetermined event, such as expiration of a timer, before resuming step 502.

If at step 504 the gas cooler outlet temperature is greater than or equal to the first temperature threshold, the method proceeds to step 508 to adjust a pressure set point for the flash tank 105 to a value that causes Δp to increase. Using the values of FIG. 4 as an example, if the method determines that the gas cooler outlet temperature determined in step 502 is greater than or equal to 34° C., the method adjusts the pressure set point for the flash tank 105 to a value that causes Δp to increase from 8 bar (i.e., the example initial value discussed above) to 10 bar.

If at step 506 the gas cooler outlet temperature is less than or equal to the second temperature threshold, the method proceeds to step 510 to adjust the pressure set point for the flash tank 105 to a value that causes Δp to decrease. Using the values of FIG. 4 as an example, if the method determines that the gas cooler outlet temperature determined in step 502 is less than or equal to 28° C., the method adjusts the pressure set point for the flash tank 105 to a value that causes Δp to decrease from 8 bar (i.e., the example initial value discussed above) to 6 bar.

After adjusting the pressure set point for the flash tank 105 according to either step 508 or 510 (depending on whether the gas cooler outlet temperature is greater than or equal to the first threshold, or less than or equal to the second threshold), the method proceeds to step 512. At step 512, the instructs one or more components of the refrigeration system to operate according to a configuration that causes a measured pressure of the flash tank 105 to move toward the pressure set point determined at step 508 or 510. As an example, the method may instruct one of the compressors to operate according to a compression set point that causes the measured pressure of the flash tank 105 to move toward the pressure set point for the flash tank. In certain embodiments, the measured pressure of the flash tank 105 may be determined based on information from a sensor (such as a sensor that measures the pressure of flash tank 105). The method then ends.

Figure 6:
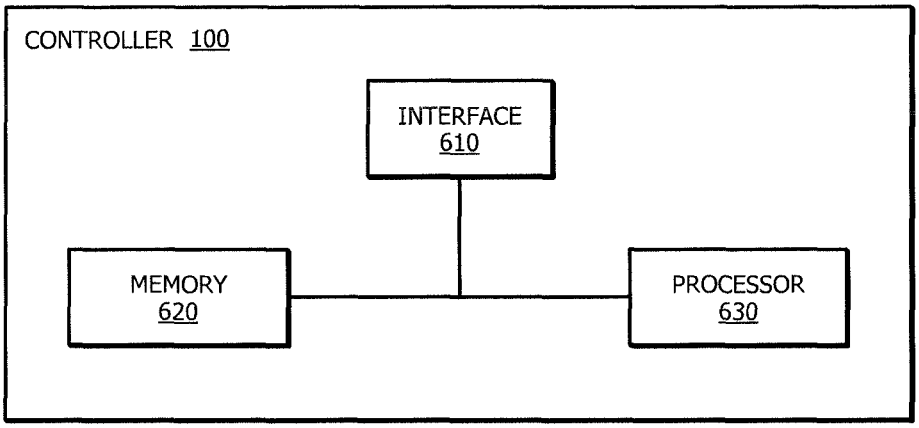
FIG. 6 illustrates an example of a controller of a refrigeration system, according to certain embodiments.

FIG. 6 illustrates an example controller 100 for a refrigeration system, such as controller 100 of FIG. 1, according to certain embodiments of the present disclosure. Controller 100 may comprise one or more interfaces 610, memory 620, and one or more processors 630. Interface 610 receives input (e.g., sensor data or system data), sends output (e.g., instructions), processes the input and/or output, and/or performs other suitable operation. Interface 610 may comprise hardware and/or software. As an example, interface 610 receives information from sensors, such as information about the ambient temperature of refrigeration system, information about the load of the refrigeration system, information about the temperature of the refrigerant at any suitable point(s) in the refrigeration system, and/or information about the pressure of the refrigerant at any suitable point(s) in the refrigeration system (e.g., temperature at the outlet of gas cooler 130, suction pressure of MT compressor 120*b*, pressure of flash tank 105, etc.). Controller 100 may compare the received information to thresholds to determine whether to adjust operation of the refrigeration system. As an example, controller 100 may compare the gas cooler outlet temperature to a threshold and increase or decrease a pressure set point associated with flash tank 105 based on the whether the gas cooler outlet temperature exceeds the threshold.

In some embodiments, if controller 100 determines to adjust operation of the refrigeration system, controller 100 sends instructions to the component(s) of the refrigeration system that controller 100 has determined to adjust. For example, controller 100 may send an instruction to compressors 120 to apply compression that causes the flash tank pressure to increase.

Processor 630 may include any suitable combination of hardware and software implemented in one or more modules to execute instructions and manipulate data to perform some or all of the described functions of controller 100. In some embodiments, processor 430 may include, for example, one or more computers, one or more central processing units (CPUs), one or more microprocessors, one or more applications, one or more application specific integrated circuits (ASICs), one or more field programmable gate arrays (FPGAs), and/or other logic.

Memory (or memory unit) 620 stores information. As an example, memory 620 may store one or more gas cooler outlet temperature thresholds and one or more corresponding pressure set points for flash tank 105. Controller 100 may use these stored gas cooler outlet temperature thresholds to determine whether to adjust the pressure set points in response to determining that the gas cooler outlet temperature has changed (e.g., based on input from a sensor). As another example, memory 620 may store logic for performing the method discussed above with respect to FIG. 5. Memory 620 may comprise one or more non-transitory, tangible, computer-readable, and/or computer-executable storage media. Examples of memory 620 include computer memory (for example, Random Access Memory (RAM) or Read Only Memory (ROM)), mass storage media (for example, a hard disk), removable storage media (for example, a Compact Disk (CD) or a Digital Video Disk (DVD)), database and/or network storage (for example, a server), and/or other computer-readable medium.

Modifications, additions, or omissions may be made to the systems, apparatuses, and methods described herein without departing from the scope of the disclosure. The components of the systems and apparatuses may be integrated or separated. Moreover, the operations of the systems and apparatuses may be performed by more, fewer, or other components. For example, the refrigeration system may include any suitable number of compressors, condensers, condenser fans, evaporators, valves, sensors, controllers, and so on, as performance demands dictate. One skilled in the art will also understand that the refrigeration system can include other components that are not illustrated but are typically included with refrigeration systems. Additionally, operations of the systems and apparatuses may be performed using any suitable logic comprising software, hardware, and/or other logic. As used in this document, "each" refers to each member of a set or each member of a subset of a set.

Modifications, additions, or omissions may be made to the methods described herein without departing from the scope of the disclosure. The methods may include more, fewer, or other steps. Additionally, steps may be performed in any suitable order.

Although this disclosure has been described in terms of certain embodiments, alterations and permutations of the embodiments will be apparent to those skilled in the art. Accordingly, the above description of the embodiments does not constrain this disclosure. Other changes, substitutions, and alterations are possible without departing from the spirit and scope of this disclosure.

The invention claimed is:

1. A transcritical refrigeration system operable to circulate carbon dioxide ($CO_2$) refrigerant through the transcritical refrigeration system in order to provide refrigeration, the transcritical refrigeration system comprising:

a flash tank operable to supply the $CO_2$ refrigerant, in liquid form, to a low temperature refrigeration case and a medium temperature refrigeration case;

a low temperature compressor operable to compress the $CO_2$ refrigerant discharged from the low temperature refrigeration case;

a medium temperature compressor operable to compress at least one of the $CO_2$ refrigerant discharged from the medium temperature refrigeration case and the $CO_2$ refrigerant discharged from the low temperature compressor;

a parallel compressor operable to compress $CO_2$ flash gas discharged from the flash tank;

an ejector operable to compress at least one of the $CO_2$ refrigerant discharged from the medium temperature refrigeration case and the $CO_2$ refrigerant discharged from the low temperature compressor;

a gas cooler operable to cool the $CO_2$ refrigerant discharged from the medium temperature compressor and the parallel compressor; and a controller operable to dynamically adjust a pressure set point for the flash tank, wherein the controller dynamically adjusts the pressure set point for the flash tank based on a temperature at an outlet of the gas cooler;

wherein in response to determining that the temperature at the outlet of the gas cooler has increased such that it exceeds a temperature threshold, the controller adjusts the pressure set point for the flash tank in order to increase $\Delta p$, wherein $\Delta p$ is the difference between the pressure of the flash tank and suction pressure of the medium temperature compressor.

2. The transcritical refrigeration system of claim 1, wherein in response to determining that the temperature at the outlet of the gas cooler is less than or equal to 30° C., the controller adjusts the pressure set point for the flash tank such that $\Delta p$ is less than or equal to 8 bar, wherein $\Delta p$ is the difference between the pressure of the flash tank and suction pressure of the medium temperature compressor.

3. The transcritical refrigeration system of claim 1, wherein in response to determining that the temperature at the outlet of the gas cooler is greater than or equal to 32° C., the controller adjusts the pressure set point for the flash tank such that $\Delta p$ is greater than or equal to 8 bar, wherein $\Delta p$ is the difference between the pressure of the flash tank and suction pressure of the medium temperature compressor.

4. The transcritical refrigeration system of claim 1, the controller further operable to:

determine one or more compression set points operable to cause a measured pressure of the flash tank to move toward the pressure set point for the flash tank; and instruct each of the medium temperature compressor, the parallel compressor, and/or the ejector to operate according to its respective compression set point.

5. A controller for a refrigeration system, the controller comprising one or more processors and logic encoded in non-transitory computer readable memory, the logic, when executed by one or more processors, operable to:

dynamically adjust a pressure set point for a flash tank based on a temperature value, the temperature value determined from at least one of an ambient air temperature and a gas cooler outlet temperature;

determine that the temperature value has increased such that it exceeds a temperature threshold; and adjust the pressure set point for the flash tank in order to increase $\Delta p$, wherein $\Delta p$ is the difference between the pressure of the flash tank and suction pressure of a compressor of the refrigeration system.

6. The controller of claim 5, wherein the logic is operable to determine one or more compression set points operable to cause a measured pressure of the flash tank to move toward the pressure set point for the flash tank; and instruct the compressor to operate according to the compression set point.

7. The controller of claim 5, wherein the refrigeration system that the controller is operable to control comprises a transcritical refrigeration system that circulates carbon dioxide ($CO_2$) refrigerant.

8. The controller of claim 7, wherein the refrigeration system that the controller is operable to control comprises:

the flash tank operable to supply the $CO_2$ refrigerant, in liquid form, to a low temperature refrigeration case and a medium temperature refrigeration case;

a low temperature compressor operable to compress the $CO_2$ refrigerant discharged from the low temperature refrigeration case;

a medium temperature compressor, a parallel compressor, and an ejector each operable to compress the $CO_2$ refrigerant discharged from the medium temperature refrigeration case, the $CO_2$ refrigerant discharged from the low temperature compressor, and/or $CO_2$ flash gas discharged from the flash tank; and a gas cooler operable to cool the $CO_2$ refrigerant discharged from the medium temperature compressor and the parallel compressor;

wherein the controller determines the temperature value based on information from a sensor that measures temperature at the outlet of the gas cooler.

9. The controller of claim 8, wherein:

in response to determining that the temperature at the outlet of the gas cooler is less than or equal to 28° C., the controller adjusts the pressure set point for the flash tank such that Δp is less than 8 bar, wherein Δp is the difference between the pressure of the flash tank and suction pressure of the medium temperature compressor; and in response to determining that the temperature at the outlet of the gas cooler is greater than or equal to 34° C., the controller adjusts the pressure set point for the flash tank such that the Δp is greater than 8 bar.

10. A method of operating a refrigeration system, the method comprising:

determining a temperature associated with an outlet of a gas cooler that is operable to cool refrigerant received from one or more compressors and discharge the refrigerant to a flash tank via one or more ejectors;

performing a comparison that compares the temperature associated with the outlet of the gas cooler to a temperature threshold;

adjusting a pressure set point for the flash tank based on the comparison; and instructing one or more components of the refrigeration system to operate according to a configuration that causes a measured pressure of the flash tank to move toward the pressure set point for the flash tank.

11. The method of claim 10, wherein in response to determining that the temperature associated with the outlet of the gas cooler has increased such that it exceeds the temperature threshold, adjusting the pressure set point for the flash tank in order to increase Δp, wherein Δp is the difference between the pressure of the flash tank and suction pressure of one of the compressors.

12. The method of claim 10, wherein the method operates a transcritical refrigeration system that circulates $CO_2$ refrigerant and, in response to determining that the temperature associated with the outlet of the gas cooler is less than or equal to 30° C., adjusting the pressure set point for the flash tank such that Δp is less than or equal to 8 bar, wherein Δp is the difference between the pressure of the flash tank and suction pressure of one of the compressors.

13. The method of claim 10, wherein the method operates a transcritical refrigeration system that circulates $CO_2$ refrigerant and, in response to determining that the temperature associated with the outlet of the gas cooler is greater than or equal to 30° C., adjusting the pressure set point for the flash tank such that Δp is greater than or equal to 8 bar, wherein Δp is the difference between the pressure of the flash tank and suction pressure of one of the compressors.

14. The method of claim 10, wherein instructing the one or more components of the refrigeration system comprises instructing one of the compressors to operate according to a compression set point that causes the measured pressure of the flash tank to move toward the pressure set point for the flash tank.

* * * * *